United States Patent [19]

Braun et al.

[11] Patent Number: 4,513,715

[45] Date of Patent: Apr. 30, 1985

[54] DISTRIBUTOR INJECTION PUMP FOR INTERNAL COMBUSTION ENGINES

[75] Inventors: Wolfgang Braun, Ditzingen; Karl Konrath, Ludwigsburg; Manfred Schwarz, Gerlingen, all of Fed. Rep. of Germany

[73] Assignee: Robert Bosch GmbH, Stuttgart, Fed. Rep. of Germany

[21] Appl. No.: 541,609

[22] Filed: Oct. 13, 1983

[30] Foreign Application Priority Data

Nov. 13, 1982 [DE] Fed. Rep. of Germany ..... 3242108

[51] Int. Cl.[3] ..... F02D 1/02

[52] U.S. Cl. ..... 123/383; 123/380; 123/366; 123/503

[58] Field of Search ..... 123/383, 382, 380, 387, 123/367, 503, 366

[56] References Cited

U.S. PATENT DOCUMENTS

| | | | |
|---|---|---|---|
| 4,308,834 | 1/1982 | Eheim | 123/383 |
| 4,384,560 | 5/1983 | Jager et al. | 123/383 |
| 4,432,321 | 2/1984 | Matsuda et al. | 123/380 |
| 4,444,170 | 4/1984 | Hofer | 123/387 |

FOREIGN PATENT DOCUMENTS

| | | | |
|---|---|---|---|
| 10830 | 1/1979 | Japan | 123/387 |
| 37572 | 3/1980 | Japan | 123/380 |
| 41429 | 4/1981 | Japan | 123/383 |
| 2109956 | 6/1983 | United Kingdom | 123/383 |

*Primary Examiner*—Magdalen Y. C. Moy
*Attorney, Agent, or Firm*—Edwin E. Greigg

[57] ABSTRACT

A distributor injection pump for internal combustion engines is proposed, in which the fuel is furnished to the injection valves of the engine by means of a distributor piston executing a rotational and reciprocal movement. The distributor injection pump is provided with a full-load stop dependent on charge pressure or atmospheric pressure, which cooperates with the system comprising a centrifugal adjuster and a governor lever group and, regardless of the sleeve position of a centrifugal adjuster, determines the position of the tensioning lever counter to the force of a governing spring and an idling spring with the aid of a control member resting on the tensioning lever. In a further embodiment, the control member has an extension which upon the starting of the motor vehicle lifts the starting lever from the sleeve as long as the sleeve is at least approximately located in its outset position corresponding to zero rpm and as long as predetermined, engine-specific and/or use-specific operating conditions, at which the centrifugal adjuster would furnish an excessively large starting quantity, prevail.

10 Claims, 6 Drawing Figures

DISTRIBUTOR INJECTION PUMP FOR INTERNAL COMBUSTION ENGINES

BACKGROUND OF THE INVENTION

The invention relates to a distributor injection pump for internal combustion engines in which fuel is furnished to the injection valves of an engine by means of a cam drive effecting the delivery movement of at least one fuel distributor piston.

From the Robert Bosch GmbH publication of March, 1981 entitled "Technische Beschreibung der Verteilereinpritzpumpe Type VE, VDT-D5/2 De" (*Technical Description of Distributor Injection Pump Type VE, VDT-D5/2 De*), a distributor injection pump is already known in which a transducer device coacts with a pivoted stop lever representing a full-load stop for a tensioning lever associated with a starting lever. This transducer device is dependent either on charge pressure, in the case of motor vehicle engines with turbocharging, or on atmospheric pressure, in the case of motor vehicle engines which are subjected to extreme fluctuations in air pressure during operation. In known injection pumps of this type, as in the known devices not provided with an equivalent transducer device, an increased starting quantity is pumped when the vehicle is started. This increased quantity is determined by the distance traveled by a centrifugal adjuster sleeve position, corresponding to zero rpm, to its idling position, at which the starting lever strikes a tensioning lever. At most motor vehicle operating conditions prevailing during starting, however, this increased starting quantity is larger than the quantity that would be necessary to bring the engine up to an optimum operating condition. As a result, an unnecessarily large quantity of fuel is consumed during starting, the proportion of toxic components in the exhaust gas is higher, and soot formation is unnecessarily extensive.

OBJECT AND SUMMARY OF THE INVENTION

The distributor injection pump according to the invention has the advantage that when the motor of the centrifugal adjuster sleeve during starting, the quantity of fuel pumped is no higher than what is required to bring the engine up to optimum operation. In a particularly advantageous embodiment of the control member, it is represented as a pivotable stop lever. A two-armed embodiment of the stop lever together with a second control member, as affords a particularly simple opportunity for transmitting the parameter or parameters dependent on the engine-specific or use-specific operating conditions to the starting lever. In a particularly advantageous embodiment, the second control member is a scanning pin. Further, it is provided that in a distributor injection pump which is part of a vehicle engine having turbocharging and in which the injection quantity is controlled during normal operation by a transducer device functioning in accordance with charge pressure, this transducer device is used during starting of the motor vehicle to reduce the increased starting quantity. It is further provided that in a distributor injection pump in which the injection quantity is controlled during normal operation by a transducer device functioning in accordance with atmospheric pressure, this transducer device also is used during starting of the motor vehicle to reduce the increased starting quantity. The present invention further offers the opportunity of compensating for manufacturing tolerances which could arise with the parts used to reduce the increased starting quantity.

The invention will be better understood and further objects and advantages thereof will become more apparent from the ensuing description of preferred embodiments taken in conjunction with the drawings.

DESCRIPTION OF THE PREFERRED EMBODIMENTS

Figure 1:
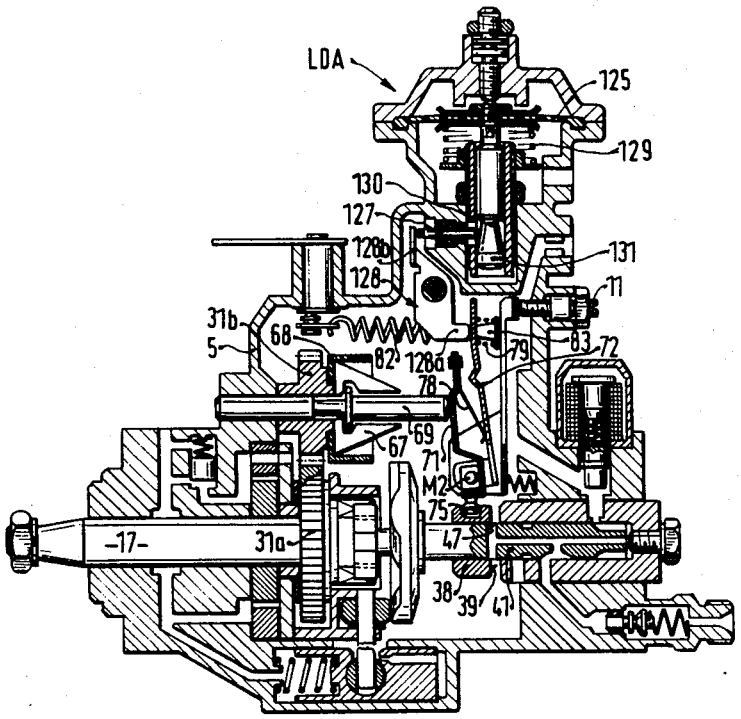
FIG. 1 PRIOR ART
FIG. 1 is a section taken through a known distributor injection pump having a full-load stop dependent on charge pressure, in which the governor lever group and the centrifugal adjuster are shown in the starting position and the stop lever of the full-load stop dependent on charge pressure determines the position of a tensioning lever.

The rpm of the engine is transmitted by the drive shaft 17 of the injection pump via gear wheels 31*a*, 31*b* to the flyweights 67 (FIG. 1). With increasing rpm, centrifugal force comes into play and the flyweights 67 are moved outward. They rotate about the knife-edge support 68 and via their inner arms displace the axially displaceable governor sleeve 69. The latter transmits the centrifugal force via a lever group, consisting of a starting lever 71 and a tensioning lever 72, until the system is in balance counter to the force of the various springs, especially the governor spring 82. Each balanced position corresponds to a specific position of the starting and tensioning levers 71, 72. The movement of the starting and tensioning levers is transmitted via a ball-headed bolt 75 onto the governor slide 38. The governor slide 38 is displaceably supported on the distributor piston. With its end face 39 together with the control bore 47 in the distributor piston 41, the governor slide 38 controls the end of the effective stroke and thus the injection quantity. The effective stroke can thereby be varied from 0 up to the starting (maximum) quantity.

When the distributor injection pump is stopped, the flyweights 67 are at rest and the governor sleeve 69 is located in the outset position. The starting lever 71 is pressed by the starting spring 78 into the starting position. As a result, the governor sleeve 38 is displaced on the distributor piston 41 into the starting-quantity position. This means that the distributor piston 41 must execute a long effective stroke (maximum pumping quantity=starting quantity) up to the point of shutoff. The result, upon starting, is the starting quantity. Even a low starting rpm suffices to displace the governor sleeve 69 counter to the soft starting spring 78 by the amount a (shown in FIG. 2). The starting lever 71 thereupon rotates about the pivot point $M_2$, and the increased starting quantity is automatically reduced to the idling quantity.

Figure 3:
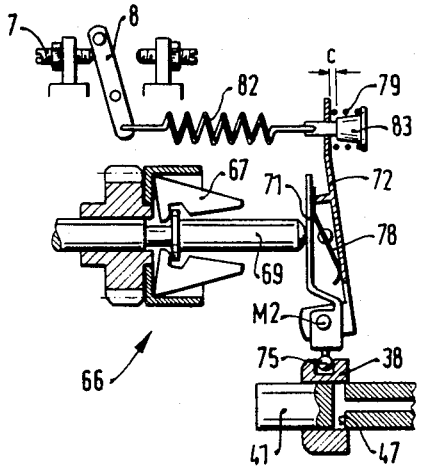
FIG. 3 PRIOR ART
FIG. 3 shows the governor lever group and the centrifugal adjuster according to FIG. 2, but in the idling position.

In the lower idling range, the rpm adjusting lever (gas pedal) 8 rests on the adjusting screw 7 (FIG. 3). As a result of the centrifugal force coming into play, the starting spring 78 is overridden, and the starting lever 71 rests on the tensioning lever 72. The regulation function is assumed by the idling spring 79 attached to the holder bolt 83. This spring 79 keeps in balance with the force generated by the flyweights 67. As a result of this balance of forces, the position of the regulating slide 38 with respect to the control bore 47 in the distributor 41 is determined, and the effective stroke is thus fixed. At an rpm above the idling range, the spring travel distance c has been traversed and the idling spring 79 is overridden.

In operation, the rpm adjusting lever 8 has a predetermined position within its pivoting range, depending upon the desired rpm. The starting and idling springs 78, 79, respectively, are overridden and have no influence on the regulation performed. The regulation function is assumed by the governor spring 82. If a change in load now occurs, for instance from an upgrade on the road, with the rpm adjusting lever in the same position, then the engine rpm drops, and thus the governor rpm drops as well. As a result, the flyweights 67 move inward and displace the governor sleeve 69 toward the left. At the same time, the starting and tensioning lever group 71, 72 also changes its position. Because of the force conditions prevailing at the governor mechanism, the lever group 71, 72 is drawn by the governor spring force in the direction of the governor sleeve. As a result, the governor slide 38 is displaced in the direction of "full". The supply quantity is increased, and the engine maintains its rpm.

As soon as the engine rpm tends to increase beyond the set-point rpm, the regulated shutoff begins. The flyweights 67 move outward and displace the governor sleeve 69 counter to the effective force of the governor spring. As a result, the starting and tensioning levers 71, 72 pivot about their common pivot point $M_2$ and displace the governor slide 38 in the direction of "stop", so that no fuel is pumped.

Figure 2:
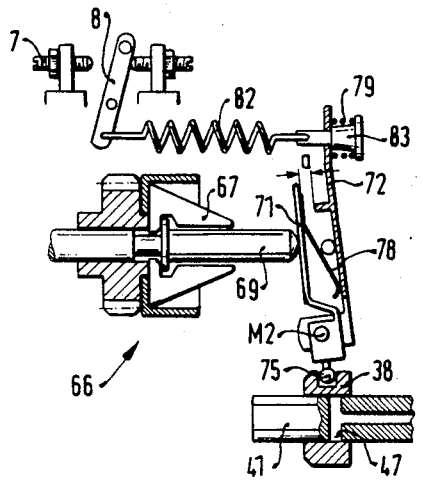
FIG. 2 PRIOR ART
FIG. 2 shows the governor lever group and the centrifugal adjuster according to FIG. 1 in the starting position at a charge pressure at which the full-load stop dependent on charge pressure does not intervene in the regulation.

Besides the system described with reference to FIGS. 1–3, which comprises the centrifugal adjuster 66 and the governor lever group including the levers 71, 72, the distributor injection pump shown in FIG. 1 also has, as a component of the rpm governor, an additional transducer device LDA, which via a stop lever 128 acting as the control member performs a charge-pressure-dependent control of the tensioning lever 72. This additional transducer device LDA, which is also known as a "charge-pressure-dependent full-load stop", is used in supercharged engines. In such engines, the fuel quantity is adapted to the increased air charge of the engine cylinders in the middle and upper rpm ranges (supercharged operation). If the supercharged engine is operating in the lower rpm range, then the air charge of the engine cylinders is low, and the fuel quantity must be adapted to this reduced air quantity. This task is performed by the additional transducer device LDA, in that in the lower rpm range a reduction of the full-load quantity is performed beyond a predetermined, selectable charge pressure.

The full-load quantity without charge pressure is established with the full-load stop screw 11, which is threaded into the governor cap 5.

In the lower rpm range, the full-load stop dependent on charge pressure is not effective, because the charge pressure generated by the exhaust gas turbocharger is not sufficient to overcome the spring force. The diaphragm 125 is located in the outset position. If as a result of increasing rpm the diaphragm is subjected to the charge pressure, then the diaphragm and the adjusting bolt 131 are displaced with the control cone 130 counter to the spring force of the compression spring 129.

As a result of the tensile force of the governor spring 82, a positive engagement exists between the tensioning lever 72, the stop lever 128, the guide pin 127 and the control cone 130. The tensioning lever 72, under the influence of this spring force, now rests on the first lever arm 128*a* of the stop lever 128, while the guide pin 127 rests on the second lever arm 128*b* of the stop lever 128. Upon a vertical movement of the adjusting bolt 131, the stop lever 128 executes a rotational movement and the governor slide 38 is displaced in the direction of an increased quantity and adapted to the increased air quantity. With the compression spring 129 and the control cone 130, the desired course of full-load correction is attained. At low rpm or if the supercharger should fail, the LDA resumes its outset position and limits the full-load quantity such that smoke-free combustion is assured.

Figure 4:
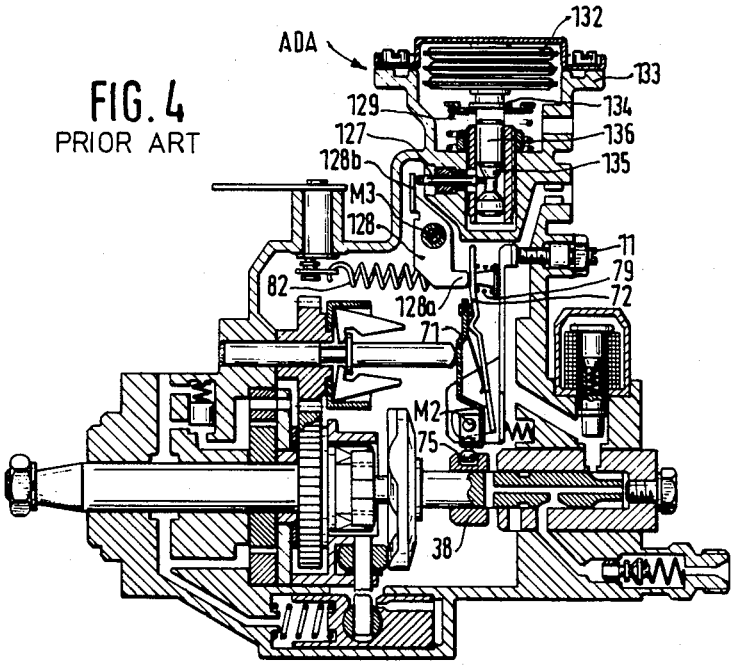
FIG. 4 PRIOR ART
FIG. 4 shows a disposition similar to that of FIG. 1, but with a full-load stop dependent on atmospheric pressure.

Besides the system described with reference to FIGS. 2 and 3 and comprising the centrifugal adjuster generally designated 66 and the group of governor levers including the levers 71, 72, the distributor injection pump shown in FIG. 4 has as a component of the rpm governor an additional transducer device ADA, which via the stop lever 128 acting as the control member performs a control of the tensioning lever 72 in accordance with atmospheric pressure. This additional transducer device ADA is also known as an "atmospheric-pressure-dependent full-load stop". In countries or regions where there is traffic on roads with extremely wide variations in altitude, the injected fuel quantity must be adapted in accordance with altitude to the air charge of the engine cylinders, which becomes poorer with increasing altitude.

The atmospheric-pressure-dependent full-load stop ADA which serves this purpose comprises a barometer capsule 132 built into the housing 133 in a vertical position, which can be fixed to a predetermined altitude setting with a securing plate 134 and a counteractive spring-loaded adjusting bolt 136. Within the functional range of the barometer capsule 132, the height of the capsule increases with decreasing air pressure. The spring-loaded adjusting bolt 136 moves counter to the spring force in the vertical direction, and the guide pin 127 acting as the second control member executes a horizontal movement because of the control cone 135. As a result, the stop lever 128 pivots about its pivot point $M_3$ and presses the tensioning lever 72 counter to the effective governor spring force in the direction of the full-load stop screw 11. The governor slide 38 is accordingly moved in the direction of "stop", and the fuel quantity is reduced in accordance with the aspirated air quantity.

Figure 5:
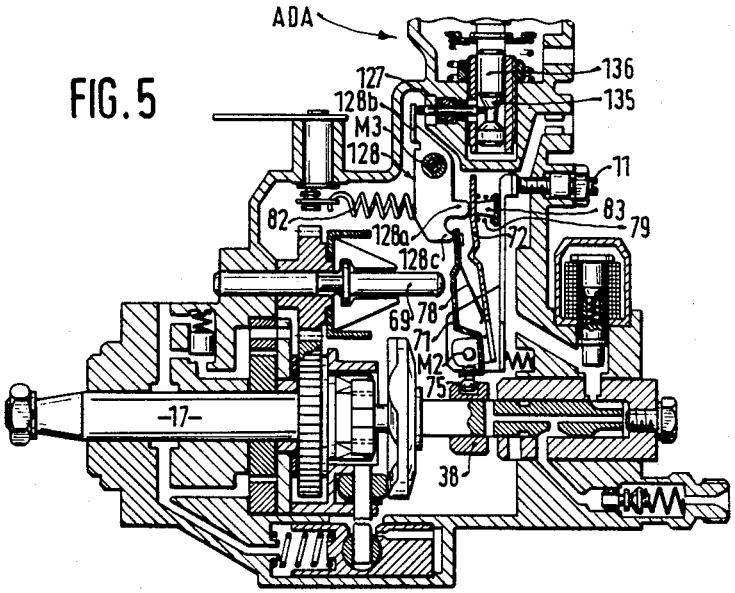
FIG. 5 shows a device similar to that of FIG. 4 in the starting position, but in which the stop lever is embodied in accordance with the invention and is located in a position at which it determines the position of the tensioning lever and the position of the starting lever.

FIG. 5 is a section through part of a distributor injection pump according to the invention and having an additional transducer device embodied as an atmospheric-pressure-dependent full-load stop ADA. Only those parts relating to the further development according to the invention of the distributor injection pump of FIG. 4 are shown. For these parts, the same reference numerals are used as in FIG. 4. In accordance with the invention, the first lever arm 128*a* of the stop lever 128 has an extension 128*c*, which lifts the starting lever 71 from the sleeve 69, which is just now in its outset position, corresponding to an engine rpm of zero. As a result, it is assured that the distributor injection pump will provide a fuel quantity during starting which is no larger than the quantity required to bring the engine to concentric operation.

Figure 6:
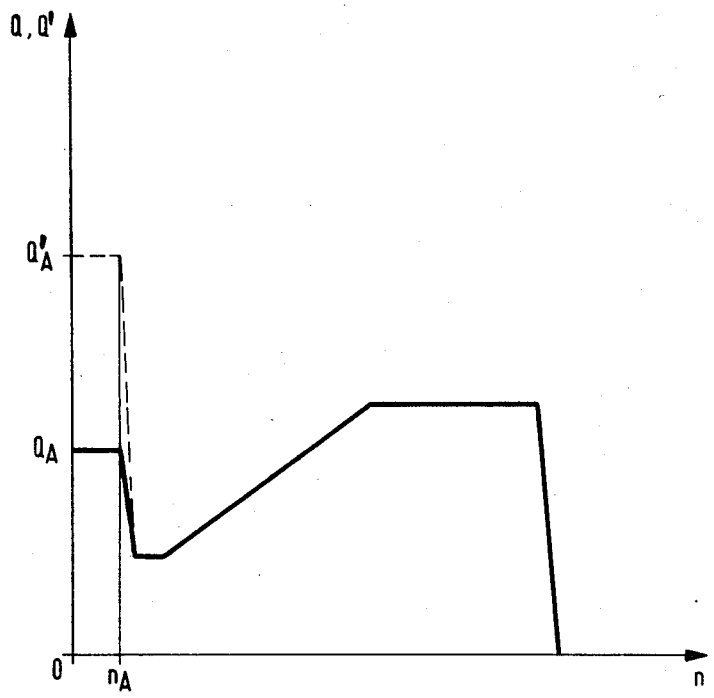
FIG. 6 is a diagram in which the full-load quantity is plotted in accordance with the rpm when the apparatus according to the invention is used.

FIG. 6 shows the full-load quantity Q (solid line) pumped with the apparatus according to the invention and as shown in FIG. 5 in comparison with the full-load quantity Q' (dashed line) pumped with known devices, both being plotted in accordance with the engine rpm n. It is clear that with the apparatus according to the invention the full-load quantity delivered to the engine by the injection pump between the rpm 0 and the starting rpm $n_A$ (starting quantity $Q_A$) is clearly reduced, as compared with conventional distributor injection pumps (starting quantity $Q_A'$).

The stop lever 128 serving as a control member and having the extension 128*c* embodied in accordance with the invention on its first lever arm 128*a* can also be used in the same manner in a distributor injection pump which is provided as shown in FIG. 1 with a charge-pressure-dependent full-load stop LDA; the same applies to distributor injection pumps having a combination full-load stop ALDA dependent on both charge pressure and atmospheric pressure, or with a hydraulically actuated adaptation device HBA.

The extension 128*c* attached to the control member 128 may be embodied as an adjustable stop.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A distributor injection pump for an internal combustion engine including injection valves in which fuel is furnished to the injection valves of said engine, said pump comprising a housing, a drive means and a distributor piston coupled to said drive means for rotational and reciprocal movement thereby, said distributor piston aspirating fuel during an intake phase from an interior chamber of said housing and during a compression phase sending said fuel on to said injection valves, an end of an injection interval being fixed by a regulating governor slide means displaceably disposed on said distributor piston and cooperating with a control bore in said distributor piston, a relative position of said slide means to said control bore in said piston being controlled by a starting lever which is pivotable about a pivot means adjustably disposed in said pump housing, said starting lever having an elongated lever arm displaceable in one direction about said pivot means by a governor sleeve of an adjuster means counter to a force of a starting spring, said adjuster means being responsive to engine rpm, said starting spring being supported on a tensioning lever supported on said pivot means in common with said starting lever, wherein upon the attainment of a predetermined idling rpm said governor sleeve displaces the starting lever into abutting relation to said tensioning lever whereby the starting spring is overridden and the starting lever with the tensioning lever resting firmly thereon directly controls a movement of the slide means while a regulating function of said slide means is assumed by an idling spring, wherein said governor sleeve operates counter to a force of said idling spring and, upon the idling rpm being exceeded, additionally operates counter to a force of a governor spring influenced by a set position of a gas pedal, said pump being provided with a transducer device, which determines an utmost position of the tensioning lever in the direction of a force of the governor spring and of the idling spring with the aid of a control member abutting said tensioning lever, said control member having an extension, which upon starting of said engine lifts said starting lever from said governor sleeve in the presence of predetermined engine and use-specific operating conditions, as long as said governor sleeve is at least approximately in its outset position corresponding to zero rmp.

2. A distributor injection pump as defined by claim 1, in which the control member is embodied as a stop lever pivotable about a second pivot means extending parallel to said first pivot means, one lever arm of which control member rests on said tensioning lever and said extension being a component of this lever arm.

3. A distributor injection pump as defined by claim 2, in which the stop lever has a second lever arm, on which at least one parameter dependent on a predetermined, engine and use-specific operating conditions is transmitted via a second control member.

4. A distributor injection pump as defined by claim 3, in which the second control member is a scanning pin.

5. A distributor injection pump as defined by claim 4, in which said transducer device serves to take into account a charge pressure in a combustion chamber of a cylinder of said engine, said charge pressure being dictated by a turbocharging operation of said engine, said transducer device including a diaphragm subjected to the charge pressure, which diaphragm transmits a charge-pressure-dependent deflection counter to the force of a compression spring to an adjusting bolt provided with a control cone and from said adjusting bolt via said control cone to said scanning pin which is in engagement with said second lever arm of said stop lever.

6. A distributor injection pump as defined by claim 4, in which said transducer device serves to take an atmospheric pressure to which said engine is subjected into consideration, said transducer device including a barometer capsule subjected to atmospheric pressure, which transmits its atmospheric-pressure-dependent deflection counter to the force of a compression spring to an adjusting bolt provided with a control cone and from said adjusting bolt via the control cone to said scanning pin which is in engagement with said second lever arm of said stop lever.

7. A distributor injection pump as defined by claim 3, in which said extension attached to the first mentioned control member is embodied as an adjustable stop.

8. A distributor injection pump as defined by claim 4, in which said extension attached to the first mentioned control member is embodied as an adjustable stop.

9. A distributor injection pump as defined by claim 5, in which said extension attached to the first mentioned control member is embodied as an adjustable stop.

10. A distributor injection pump as defined by claim 6, in which said extension attached to the first mentioned control member is embodied as an adjustable stop.

* * * * *